US005094385A

United States Patent [19]

Antczak et al.

[11] Patent Number: 5,094,385

[45] Date of Patent: Mar. 10, 1992

[54] CONTAINER

[76] Inventors: Edwin A. Antczak, 4520 W. 115 Pl., Alsip, Ill. 60658-2202; Mark O. Faltynek, 3424 W. 82 St., Chicago, Ill. 60652; Daniel F. Garbaczewski, 13713 Cave Creek Ct., Lockport, Ill. 60441; James J. Garbaczewski, 8175 S. Tripp St., Chicago, Ill. 60652

[21] Appl. No.: 492,053

[22] Filed: Mar. 12, 1990

[51] Int. Cl.[5] ..... B65D 5/56

[52] U.S. Cl. ..... 229/110; 220/443; 229/40; 229/DIG. 2; 229/DIG. 4

[58] Field of Search ..... 229/40, 110, 902, 906, 229/DIG. 2, 120, DIG. 14, DIG. 4; 206/424; 220/416, 418, 441, 443

[56] References Cited

U.S. PATENT DOCUMENTS

| | | | |
|---|---|---|---|
| 659,943 | 10/1900 | Warner | 229/DIG. 2 |
| 1,324,144 | 12/1919 | Cone | 229/198.2 |
| 1,449,409 | 3/1923 | Hunt | 229/DIG. 4 |
| 1,849,065 | 3/1932 | Biederman | 229/DIG. 2 |
| 2,012,131 | 8/1935 | Kondolf | 229/DIG. 2 |
| 2,533,773 | 12/1950 | Foret | 229/DIG. 14 |
| 2,547,005 | 4/1951 | Herrick et al. | 229/DIG. 2 |
| 2,782,977 | 2/1957 | Thmpson | 229/DIG. 2 |
| 3,042,278 | 7/1962 | McCullough | 229/DIG. 2 |
| 3,084,843 | 4/1963 | Urban . | |
| 3,098,563 | 7/1963 | Skees . | |
| 3,144,979 | 8/1964 | Young | 220/443 |
| 3,203,617 | 8/1965 | Paige | 229/DIG. 2 |
| 3,203,618 | 8/1965 | Andrews et al. | 229/40 |
| 3,521,812 | 7/1970 | Moers et al. . | |
| 3,616,989 | 11/1971 | Martinek et al. . | |
| 3,884,352 | 5/1975 | Pilz, III et al. . | |
| 3,896,990 | 7/1975 | Sieffert . | |
| 3,931,926 | 1/1976 | Bensen | 229/198.2 |
| 3,944,131 | 3/1976 | Weiss | 229/40 |
| 3,973,721 | 8/1976 | Nakave | 229/120 |
| 4,373,636 | 2/1983 | Hoffman . | |
| 4,441,626 | 4/1984 | Hall . | |
| 4,721,243 | 1/1988 | Mercurio . | |

FOREIGN PATENT DOCUMENTS

| | | | |
|---|---|---|---|
| 977069 | 12/1964 | United Kingdom | 229/DIG. 4 |
| 1033661 | 6/1966 | United Kingdom | 229/8 |

*Primary Examiner*—Gary E. Elkins

*Attorney, Agent, or Firm*—Marshall, O'Toole, Gerstein, Murray & Bicknell

[57] ABSTRACT

A container made of a single-faced paperboard blank formed a corrugated paperboard layer and a substantially flat paperboard layer has scored lines or cuts which define a bottom portion, a cover, a cover support and four side walls. The boundaries of the side walls are defined by a plurality of substantially parallel score and slits that meet at a plurality of points so as to form side walls which have generally triangular ends. The container has four external vents for moisture to pass from the interior of the container to the outside, and three internal vents to allow moisture to pass from the interior of the container to the space between the corrugated and flat paperboard layers.

15 Claims, 1 Drawing Sheet

Fig. 1
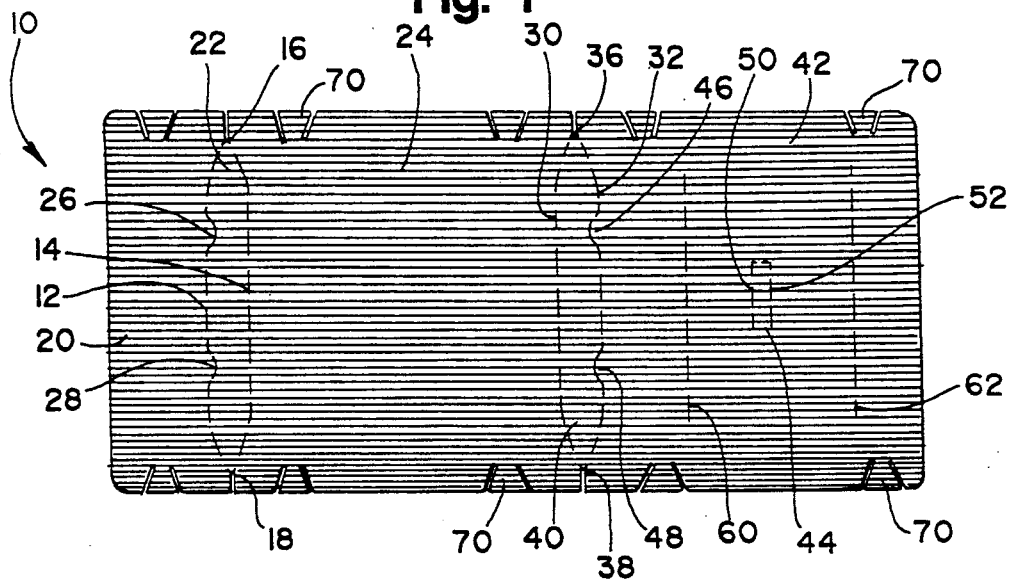
Fig. 2
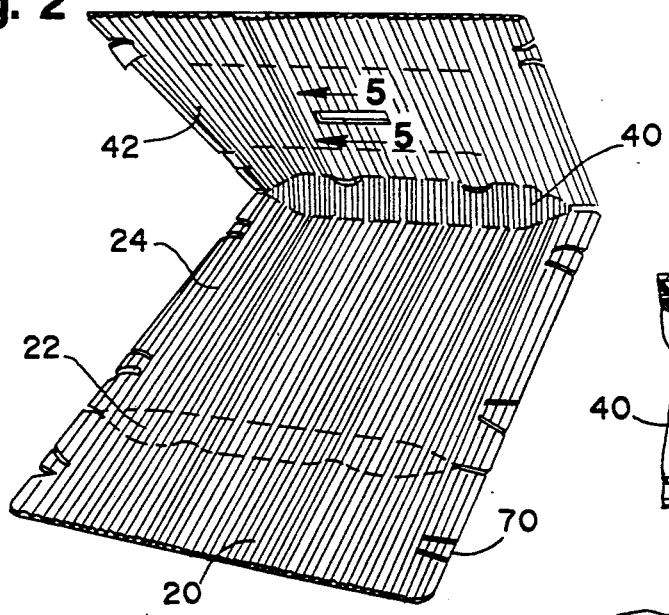
Fig. 4
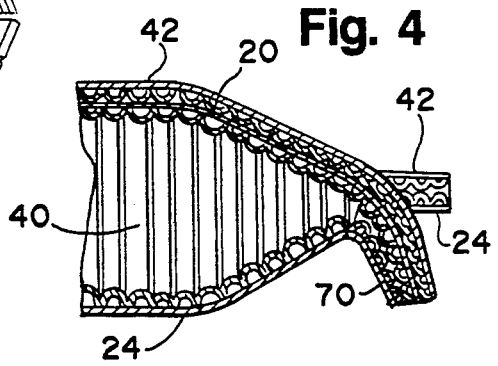
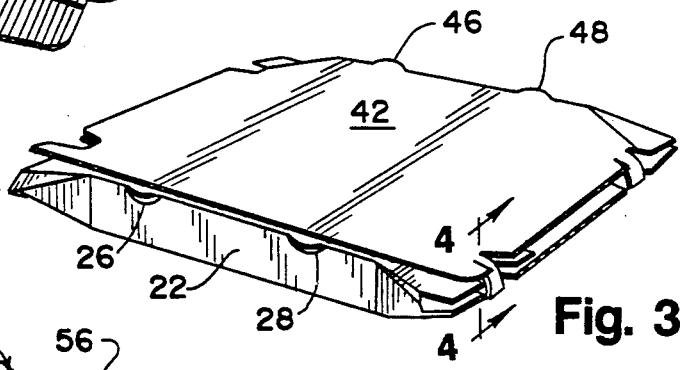
Fig. 3
Fig. 5
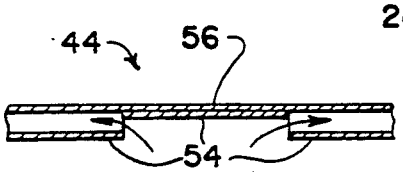

CONTAINER

BACKGROUND OF THE INVENTION

The present invention relates to containers for temporarily storing and/or delivering prepared hot or cold foods or other chattel, and more particularly a box for temporarily storing or delivering a food item such as a hot pizza.

Corrugated containers are frequently used to temporarily store foods that have been heated. For example, corrugated boxes are often used to store pizzas during delivery. Such a corrugated box is likely made from a triple sheet of paper (doublefaced corrugated) that has been selectively cut and creased to facilitate folding the sheet of corrugated material into a box. Desirable characteristics for a food container such as a box include sufficient rigidity to prevent collapse of the box under strain, sufficient thermal characteristics to prevent the food item from severe temperature change, and sufficient ventilation to allow escape or retention of moisture from the interior of the box to prevent the food item from becoming soggy or dehydrated.

An example of a pizza box with several of these advantageous characteristics is shown in U.S. Pat. No. 4,441,626 to Hall. The Hall pizza box is formed from a unitary, double-faced corrugated cardboard blank which is creased to facilitate folding it up into a box. The pizza box includes a number of ventilation holes and has a single-faced corrugated insert that is glued to the bottom portion of the pizza box. The corrugated insert is stated to provide the advantages of preventing grease from dripping from the box and facilitate good air circulation within the pizza box to prevent the pizza crust from becoming soggy.

While the foregoing advantages are generally desirable, the Hall pizza box suffers from a number of disadvantages due to increased material requirements and a more complicated assembly procedure. For example, the bottom portion of the Hall pizza box requires two corrugated paperboard layers and three flat paperboard layers. Also, the Hall pizza box requires a relatively complicated manner of folding the corrugated board blank to form the box. The Hall pizza box requires at least seven folds of the blank to form the box. It is obvious that the necessity of making more folds would require an increased assembly time, which of course, would contribute more to the cost of labor.

SUMMARY OF THE INVENTION

These and other disadvantages of previous food containers are overcome by the present invention, which is a food container for temporarily storing a food item, such as pizza for example. The box is formed of two layers, a flat paperboard layer and a corrugated paperboard layer. The two layers are typically bonded together by a conventional adhesive, as appropriate for the specific application. The combination of the two paperboard layers bonded together is referred to as single-faced board. When the box is assembled, the flat paperboard layer faces the exterior of the box and the corrugated layer faces the interior of the box. As a result, when a food item such as a pizza is placed inside the box, the pizza is supported on the corrugated layer in the bottom of the box so that air may circulate between the crust of the pizza and the bottom of the box to prevent the crust from becoming soggy. Since the box consists of only two paperboard layers, a substantial amount of material is saved in the construction of the box. Since the carton blank is rectangular in shape, it requires no stripping (removal of waste) therefore, no waste is added to the manufacturing process. This rectangular design is unencumbered with protruding tabs and will sustain little or no damage during shipping.

The box has an advantageous structure that enhances the strength of the box while being very simple in design. In particular, the box is formed by folding the single-faced board described above in accordance with four scored lines in the board. The four scored lines are made by crushing the corrugated layer, but not the flat layer; however, other methods of forming lines could be used. As a result, the folding of the board along the lines is easily accomplished.

The pattern of the four scored lines allows for very easy folding of the box as well as enhancing structural integrity of the box. A first pair of the lines define a first substantially planar side wall between a cover support portion of the box and the bottom of the box. These two lines are substantially parallel, but meet at two respective points towards the edges of the single-faced board. As a result of the meeting of the lines, the side wall thus formed has ends that are generally triangular in shape. A second pair of lines is formed similarly to the first pair, and thus defines a second substantially planar side wall with triangular ends.

The particular pattern of scored lines enhances the strength of the resultant box and simplifies the folding of the board to form the box. The folding of the board is simplified because the two folds in each of the two side walls are made automatically when the board is bent, and because there is no need to make additional folds to form the other two side walls of the box.

Another feature of the invention is the use of internal vents which allow moisture to pass from the interior of the box to the dead space between the corrugated layer and the flat layer in the single-faced board to prevent a food item such as a pizza crust from becoming soggy. The internal vents include a first type of vent comprising a slit in the corrugated layer that allows for a relatively low rate of air and moisture transfer, and a second type of vent comprising a pair of slits with the corrugated layer between the two slits being crushed down flat. The second type of vent allows for an increased rate of air and moisture transfer between the interior of the box and the dead space between the corrugated and flat layers of the single-faced board. While the typical construction is envisioned to be paper, other materials and/or combinations such as film or paper laminates convey similar advantages relative to current use and design. When the package is utilized for non-food applications, the use of recycled paper in its fabrication is envisioned.

These and other objects, features, and advantages of the present invention will be apparent to those of ordinary skill in the art in view of the detailed description of the preferred embodiments, which is made with reference to the drawings, a brief description of which is provided below.

BRIEF DESCRIPTION OF THE DRAWINGS

FIG. 1 is a top view of a food container or package blank in accordance with the preferred embodiment of the invention;

FIG. 2 is a perspective view of the package of FIG. 1 in a partially folded configuration;

FIG. 3 is a perspective view of the package in its assembled state;

FIG. 4 is a partial side view of the package taken along lines 4—4 in FIG. 3; and FIG. 5 is a partial side view of the package taken along lines 5—5 in FIG. 2.

DETAILED DESCRIPTION OF THE PREFERRED EMBODIMENT

The preferred embodiment of the invention is formed from a rectangular sheet of corrugated paperboard 10 as shown in FIG. 1. The sheet of paperboard 10 comprises two layers of paperboard, a flat layer and a corrugated layer bonded directly to the flat layer in a conventional manner by adhesive. The flat layer of paperboard may be 42 pounds per ream weight kraft paper, based upon a ream size of 500 sheets of 24" by 36" sheets, and the corrugated layer may be 33 pounds per ream weight kraft paper. Various sizes of corrugations commonly known in the corrugated industry could be used. The adhesive used to bond the two layers together may be a corn starch based adhesive commonly used in the corrugated industry. The combination of a flat layer of paperboard and a corrugated layer as described above is referred to in the corrugated industry as single-faced corrugated board.

The single-faced corrugated board 10 of FIG. 1 has a number of scores formed therein to facilitate folding of the board into a box. Now referring to FIG. 1, a first pair of scores, as indicated by dotted lines 12, 14, extend across almost the entire width of the board 10. Scores that are represented by dotted lines in FIGS. 1 and 2 extend through both layers of the board 10. With one exception which is described below, the scores shown by dotted lines are made to facilitate folding the board into a box.

Each of the slits 12, 14 has a substantially linear first portion and two substantially linear second portions. The first linear portions of the scores 12, 14 are substantially parallel to each other and are substantially parallel to the width of the board 10. One of the linear second portions of the scores 12 joins one of the second linear portions of the scores 14 at a first point 16 near the top of the board 10 in FIG. 1, and these two portions of the scores 12, 14 generally form two sides of a triangle. The other two linear second portions of the scores 12, 14 join at a second point 18 near the bottom of the board 10, and these portions generally form two sides of another triangle. The points 16, 18 lie between the two linear extensions of the substantially linear first portions of the scores 12, 14, and the area of the board 10 between the scores 12, 14 is not crushed (or scored).

There is a slit through both board layers from the point 16 to the top edge of the board and a slit through both layers from the point 18 to the bottom edge of the board 10. The scores 12, 14 define three portions: a cover support portion 20 to the left of the score 12, a side wall 22 in between the scores 12, 14, and a bottom portion 24 to the right of the score 14. When the board 10 is folded into a box, the portion 20 will act as a support for the cover of the box and will hold the top of the side wall 22 in place. The ends of the side wall 22 are generally triangular in shape due to the second substantially linear portions of the scores 12, 14 meeting at the points 16, 18. The score 12, which defines the top edge of the side wall 22 when the board is folded into a box, has two semicircular cuts 26, 28 which pass through both layers of the board 10 to define semicircular vents to allow the escape of moisture from the interior of the box.

The semicircular cuts forming the vents are advantageous in that no waste board or corrugated cutouts are formed. This is important because otherwise all cutouts would have to be removed from the board 10 so that no cutouts would be inadvertently left within the food container and accidentally swallowed.

A second substantially parallel pair of scores, as indicated by dotted lines 30, 32, extend across almost the entire width of the board 10. Each of the slits 30, 32 has a substantially linear first portion and two substantially linear second portions. The first linear portions of the scores 30, 32 are substantially parallel to each other and are substantially parallel to the width of the board 10. One of the second linear portions of the score 30 joins one of the second linear portions of the score 32 at a first point 36 near the top of the board 10 in FIG. 1, and these two portions of the scores 30, 32 generally form two sides of a triangle. The other two second linear portions of the scores 30, 32 join at a second point 38 near the bottom of the board 10, and these portions generally form two sides of another triangle. The points 36, 38 lie between the two linear extensions of the substantially linear first portions of the scores 30, 32, and the area of the board 10 between the scores 30, 32 is substantially unscored.

There is a slit through both board layers from the point 36 to the top edge of the board and a slit through both layers from the point 38 to the bottom edge of the board 10. Score 32 is a perforated score to facilitate the top of this container to be torn away and used as a serving tray by itself separate from the rest of this container (Portion 42). The slits 30, 32 define three portions: the bottom portion 24, a second side wall 40, and a top portion or cover 42. The slit 32 includes two semicircular cuts 46, 48 through both layers of the board 10 to define a second pair of semicircular vents.

The cover 42 has an internal vent 44 (see FIG. 5) which allows hot air and moisture from the interior of the box to enter the dead space between the corrugated layer and the flat layer that would normally be sealed off from any fluid communication with the interior of the box. This helps to stabilize the temperature of the pizza or food contained therein. The vent 44 comprises a vertical slit represented by a dotted line 50 through the corrugated layer only and a second vertical slit represented by a dotted line 52 through the corrugated layer. The cardboard flutes between the vertical slits 50, 52 are crushed down or flattened to enhance the ease of air and moisture transfer from the interior of the box to the area between the corrugated layer and the flat layer. Referring to FIG. 5, the vent 44 is shown in more detail. The corrugated cardboard layer 54 bonded to the flat layer 56 is flattened so as to allow air and moisture from the interior of the box to enter the space between the corrugated layer 54 and the flat layer 56 as indicated by the two arrows.

Now referring back to FIG. 1, a pair of vertical slits 60, 62 through the corrugated layer in the cover 42 also act as internal vents from the interior of the box to the spaces between the corrugated layer and the flat layer. However, unlike the vent 44, there are no crushed portions of the corrugated layer adjacent the slits 60, 62. As a result, the capability of air and moisture transfer from the interior of the box into the areas between the corrugated layer and the flat layer enabled by the slits 60, 62 is less than that enabled by the vent 44.

Thus, the internal vents 60, 62 provide for a first degree of relatively slow air transfer from the interior of the box to the dead space areas between the cardboard layers of the box, and the internal vent 44 provides a second degree of relatively fast air and moisture transfer from the interior of the box to the dead space areas. As a result, the internal humidity of the box may be controlled by choosing various sizes, locations and combinations of the internal vents 44, 60, 62.

The board 10 also has ten locking tabs 70 formed therein, each of which is formed by a pair of angled or converging slits through both layers of the board 10. The cover support portion 20 has two of the tabs 70 formed therein; the bottom 24 has four of the tabs 70 formed therein; and the cover 42 has four of the tabs 70 formed therein.

The tabs 70 are positioned such that certain pairs of the tabs positionally coincide with other selected pairs in order to facilitate the tight closure of the box. In particular, when the board 10 is folded into a box, the two tabs 70 at the left-hand portion of the bottom 24 lie directly underneath the two tabs in the cover support 20, which in turn lie directly beneath the two right-hand tabs of the cover 42. In addition, the two tabs 70 formed in the right-hand portion of the bottom 24 lie directly beneath the two tabs 70 formed in the left-hand portion of the cover 42. When the board 10 is folded along the four score lines 12, 14, 30, 32 and the tabs 70 overlie each other as described above, the box is sealed by bending the tabs 70 to a downward or upward pointing direction, as shown in FIG. 4.

The manner of folding the single-faced board 10 of FIG. 1, which may be referred to as a food container blank, into a fully assembled box as shown in FIG. 3 is very simple and labor-saving. After a pizza or other food product has been placed on the bottom 24 of the blank 10, the cover support 20 of the board 10 is lifted upwards with respect to the bottom 24 and folded over so that it lies over the bottom 24 in a direction generally parallel to the bottom 24. During the folding over of the board, due to the score lines 12, 14 and the fact that they meet at points 16, 18, the board 10 will automatically bend along the slits 12, 14, and the worker will not need to manually make a separate fold along each slit 12, 14.

After the cover support 20 is folded over, the cover 42 is raised with respect to the bottom 24 and folded over the bottom 24 and cover support 20. The board 10 will automatically bend along the score lines 30, 32 so that two separate folding actions will not be necessary. When both the cover support 20 and the cover 42 are folded over, the tabs 70 will overlie each other as described above. Each set of tabs 70 is then bent downwards in order to close the box.

The automatic bending of the board along the scored lines 12, 14, is facilitated by the placement of the points 16, 18 between the linear extensions of the substantially linear first portions of the lines 12, 14, and the automatic bending is also facilitated by placement of the points 36, 38 between the linear extensions of the substantially linear first portions of the lines 30, 32. The automatic bending is also facilitated by the fact that the areas between the lines 12, 14 and the lines 30, 32 are unscored so that substantially planar side walls 22, 40 are formed.

Referring to FIG. 4, it can be seen that the other two side walls of the box are formed partly by the cover 42 and partly by the bottom 24. It may be noted that the since the lines of corrugation run lengthwise with respect to the board 10 as shown in FIG. 1, after the tabs 70 are locked, the escape of hot air from the interior of the box through the side walls of the box formed by the cover 42 and bottom 24 may be inhibited.

It should be noted that, while the scores 12, 14, 30 crush only the corrugated layer of the single-face board, the unique folding advantages of the present invention could be achieved by various scored, slit or perforated lines along the same or a similar pattern as the lines 12, 14, 30, 32. For example, instead of having substantially continuous scores that crush only the corrugated layer of the single-faced board, these scored lines could include "dotted slits" having first portions that cut through both the corrugated and the substantially flat paperboard layers and second portions cutting only through the corrugated layer as in line 32. Alternatively, the second portions may not cut the corrugated layer at all. The scored lines may comprise indentations without any cutting of the cardboard layers. All that is required for the scored lines to facilitate the unique folding advantages of the present invention is that some type of scored lines be made generally in accordance with the pattern of the scores 12, 14, 30, 32 and that the scored lines have the capability of holding the various portions of the food container or box together.

Further modifications and alternative embodiments of the invention will be apparent to those skilled in the art in view of the foregoing description. Accordingly, this description is to be construed as illustrative only, and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed is:

1. A container comprising:

a two-layer single-faced bottom portion, said bottom portion having a substantially flat layer on the exterior of the container and a corrugated layer on the interior of the container so that, when an item is placed on said corrugated layer, a substantial amount of air circulation between said corrugated layer and the item is enabled, said corrugated layer being adhesively attached directly to said flat layer forming a plurality of spaces between said corrugated layer and said flat layer;

a first pair of single-faced side walls integrally formed with said bottom portion, said first pair of side walls having ends being generally triangular in shape;

a second pair of single-faced side walls being formed partly by a cover and a partly by said bottom portion;

a two-layer single-faced cover integrally formed with said second pair of side walls, said cover having a substantially flat layer on the exterior of the container and a corrugated layer on the interior of the container, said corrugated layer being adhesively attached directly to said flat layer;

at least one single-faced locking tab integrally formed with said cover;

at least one single-faced locking tab integrally formed with said bottom portion, the position of said cover and bottom portion locking tabs coinciding when said container is assembled so that said locking tab may be bent downwards to facilitate closure of said cover;

a first internal vent allowing a first rate of moisture transfer between the interior of the container and the spaces between said corrugated layer and said flat layer; and a second internal vent allowing a second rate of moisture transfer between the interior of the container and the spaces between said corrugated layer and said flat layer.

2. A container of claim 1 further comprising a third integral vent formed in the cover, the third integral vent having at least one pair of slits through the corrugated layer of the cover wherein the corrugated layer between the slits is substantially flattened.

3. A container of claim 1 wherein the first pair of side walls have the corrugated layer transverse to the plane of the bottom portion.

4. A container comprising:

a two-layer single-face bottom portion, said bottom portion having a substantially flat layer on the exterior of the container and a corrugated layer on the interior of the container so that, when an item is placed on said corrugated layer, a substantial amount of air circulation between said corrugated layer and the item is enabled, said corrugated layer being adhesively attached directly to said flat layer forming a plurality of spaces between said corrugated layer and said flat layer;

a first pair of single-faced side walls integrally formed with said bottom portion, said first pair of side walls having ends being generally triangular in shape;

a two-layer single-faced cover integrally formed with said side walls, said cover having a substantially flat layer on the exterior of the container and a corrugated layer on the interior of the container, said corrugated layer being adhesively attached directly to said flat layer;

a second pair of single-faced side walls being formed partly by said cover and partly by said bottom portion;

at least one single-faced locking tab integrally formed with said cover;

at least one single-faced locking tab integrally formed with said bottom portion, the position of said locking tabs coinciding when said container is assembled so that said locking tabs may be bent downwards to facilitate closure of said cover and;

an internal vent formed in said cover, said internal vent having a pair of slits through said corrugated layer of said cover, said corrugated layer between said slits being substantially flattened and allowing the interior of the container to be in fluid communication with the spaces between said corrugated layer and said flat layer.

5. A container of claim 4 wherein the first pair of side walls have the corrugated layer transverse to the plane of the bottom portion.

6. A container comprising:

a two-layer single-faced bottom portion having a first substantially flat layer on the exterior of the container and a first corrugated layer adhesively attached directly to the flat layer on the interior of the container;

a two-layer single faced top portion having substantially flat second layer on the exterior of the container and a second corrugated layer adhesively attached directly to the flat layer;

a first pair of opposing side walls integrally formed from the bottom and top portions having a third substantially flat layer on the exterior of the container and a third corrugated layer adhesively attached directly to the flat layer wherein the corrugations of the first pair of sides are traverse to the top and bottom portions of the container and wherein the ends of the first pair of side walls are generally triangular in shape;

a second pair of opposing side walls being formed partly by the bottom and partly by the top portions; and at least one locking tap wherein a first portion of the locking top is formed in the bottom portion and a second portion of the tab is formed in the top portion and wherein the position of the first and second portions of the locking tab coincide when the container is assembled to allow the locking tabs to be bent to facilitate the connection of the top and bottom portions of the container.

7. A container of claim 6 additionally comprising:

a first type of internal vent allowing a first rate of moisture transfer between the interior of the box and the spaces between said corrugated layer and said substantially flat layer; and a second type of internal vent allowing a second rate of moisture transfer between the interior of the box and the spaces between said corrugated layer and said substantially flat layer.

8. A container of claim 6 additionally comprising an internal vent formed in said cover, said internal vent allowing the interior of the box to be in fluid communication with the spaces between said corrugated layer and said substantially flat layer of said cover.

9. A container of claim 6 wherein said internal vent comprises a pair of slits through said corrugated layer of said cover and said corrugated layer between said slits being substantially flattened.

10. A container blank comprising a two-layer single-faced substrate having a substantially flay exterior layer and a corrugated interior layer adhesively attached directly to the flat layer wherein the corrugations form a plurality of substantially parallel spaces on the substrate;

a first pair of essentially parallel scored lines transverse to the corrugated spaces wherein the first pair of parallel line taper to meet at opposite edges of the substrate;

a second pair of essentially parallel scored lines transverse to the corrugated spaces and displaced from the first set of parallel scored liens wherein the second pair of parallel lines taper to meet at opposite edges of the substrate.

11. A container blank of claim 10 wherein the score lines flatten the corrugated layer of the single-faced substrate.

12. A container blank of claim 10 wherein the score lines cut through the corrugated layer of the single-faced substrate.

13. A container blank of claim 12 wherein the scored lines are substantially continuous.

14. A container blank of claim 10 being essentially free of cut outs.

15. A container blank of claim 10 further comprising at least one pair of slits in the corrugated layer providing at least one vent to allow the transfer of moisture form the interior of a container formed from the container blank to the exterior of the container.

* * * * *